United States Patent [19]

Dyson

[11] 4,373,228

[45] Feb. 15, 1983

[54] VACUUM CLEANING APPLIANCES

[76] Inventor: James Dyson, Sycamore House, Bathford, Bath, Avon, BA1 7RS, England

[21] Appl. No.: 140,497

[22] Filed: Apr. 15, 1980

[30] Foreign Application Priority Data

Apr. 19, 1979 [GB] United Kingdom ..... 7913690

[51] Int. Cl.[3] ..... A47L 9/16

[52] U.S. Cl. ..... 15/350; 15/346; 15/352; 15/353; 55/345; 55/429; 55/449; 55/459 R

[58] Field of Search ..... 15/331, 335, 345, 346, 15/350, 351, 352, 353; 55/459 R, 459 A, 459 B, 449, 429, 345

[56] References Cited

U.S. PATENT DOCUMENTS

| | | | |
|---|---|---|---|
| 1,220,641 | 3/1917 | Kent | 55/459 R X |
| 1,664,092 | 3/1928 | Squires | 15/346 X |
| 1,759,947 | 5/1930 | Lee | 15/351 X |
| 2,071,975 | 2/1937 | Holm-Hansen et al. | 55/459 R X |
| 2,300,266 | 10/1942 | Smellie | 15/350 X |
| 2,824,335 | 2/1958 | Moffat | 55/459 R |
| 2,867,833 | 1/1959 | Duff | 15/350 X |
| 3,308,609 | 3/1967 | McCulloch et al. | 55/449 X |
| 3,425,192 | 2/1969 | Davis | 55/345 |
| 3,484,890 | 12/1969 | Case | 15/346 |
| 3,520,589 | 8/1950 | White | 55/459 R X |

FOREIGN PATENT DOCUMENTS

| | | | |
|---|---|---|---|
| 494786 | 11/1938 | United Kingdom | 15/335 |

*Primary Examiner*—Chris K. Moore

*Attorney, Agent, or Firm*—Stevens, Davis, Miller & Mosher

[57] ABSTRACT

The invention relates to vacuum cleaning appliances.

The appliance of the invention includes a cyclone unit which is operable to extract dust and other dirt from the air flow therethrough and to deposit the extracted dust and other dirt in a chamber outside the cyclone and separate from the air flow through the casing of the appliance. The extracted dirt is removed from the appliance by separation of the cyclone unit from the casing.

The appliance is convertible to act both as an upright type cleaner or a cylinder type cleaner.

8 Claims, 11 Drawing Figures

VACUUM CLEANING APPLIANCES

This invention relates generally to vacuum cleaning appliances and more particularly, but not exclusively, to portable electrically operated vacuum cleaning appliances intended for domestic use.

Hithertofore such cleaning appliances have included an electrically driven fan whereby dust, grit and other dirt engrained in a carpet is removed by suction, the dirt being deposited in a removable container such as a bag while the air drawn through the appliance by the fan is subsequently ejected into the atmosphere. In some known appliances the removal of engrained grit or dirt is assisted by the use of rotatable brushes which act to dislodge the grit or dirt as the appliance is moved across the carpet.

Known appliances of the kind described above have a number of disadvantages one of which is that the air returned to the atmosphere may still contain some dust and dirt. Secondly, such appliances are noisy as the fan is not muffled by reason of the necessity to discharge the air drawn through the appliance to the atmosphere. Furthermore, the provision of brushes is not particularly efficient for the dislodging of deeply engrained grit or dirt and has the disadvantage of wearing the carpet.

The object, therefore, of the invention is to provide an improved vacuum cleaning appliance which obviates these disadvantages and in its broadest aspect the invention provides a vacuum cleaning appliance in which the suction produced by an electrically driven fan unit draws dust laden air into a cyclone unit located in the main casing of the appliance whereby dust and other dirt is separated from the air and then deposited into a container portion of the casing. The dust-free air leaving the cyclone unit then passes into the fan unit housing for discharge therefrom after passage through the impeller of the unit. Preferably the dust-free air is discharged from the fan unit housing through jet outlets positioned adjacent or between the suction inlet apertures of the appliance.

In the preferred embodiment of the invention the fan unit housing is pivotally attached to the lower part of the main casing of the appliance so as to enable the main casing to be rotatably movable relatively to the fan unit casing to allow the appliance to pass under objects such as furniture during cleaning. The handle may be part-flexible and detachable adjacent the fan unit housing so as to allow the appliance to be used as a cylinder unit, for example, for the cleaning of curtains and furniture.

In order that the invention may be clearly understood a preferred embodiment will now be described in detail by way of example with reference to the accompanying drawings, in which.

Figure 1:
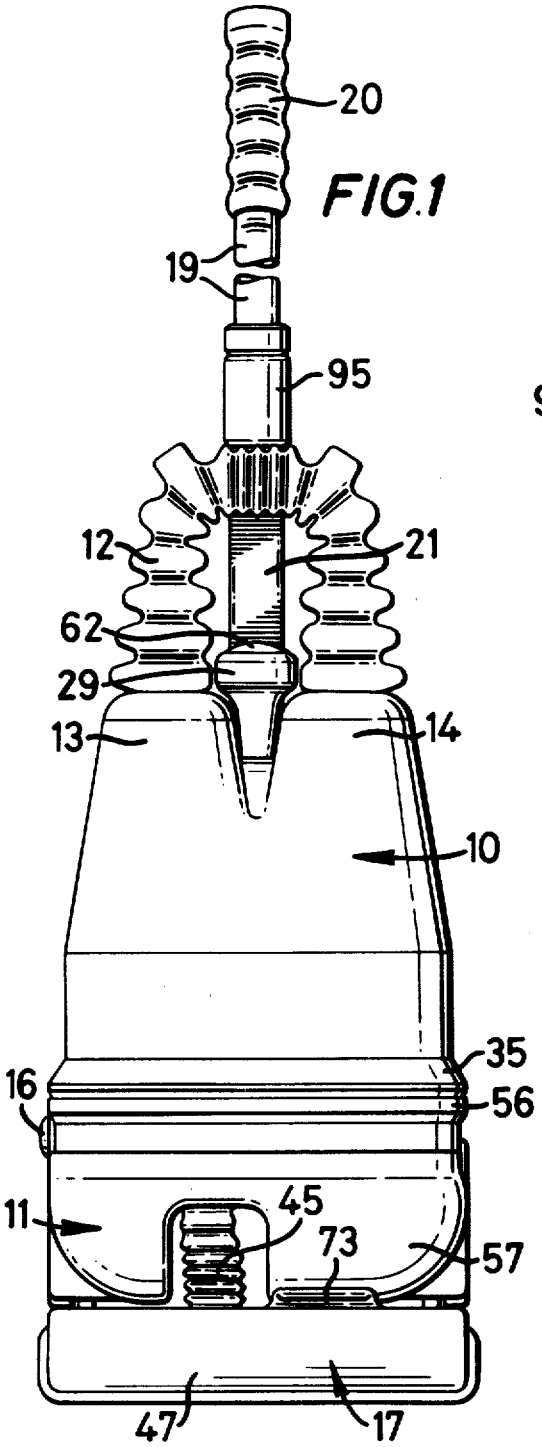
FIG. 1 is a front elevation of a vacuum cleaning appliance incorporating the features of the invention.
Figure 2:
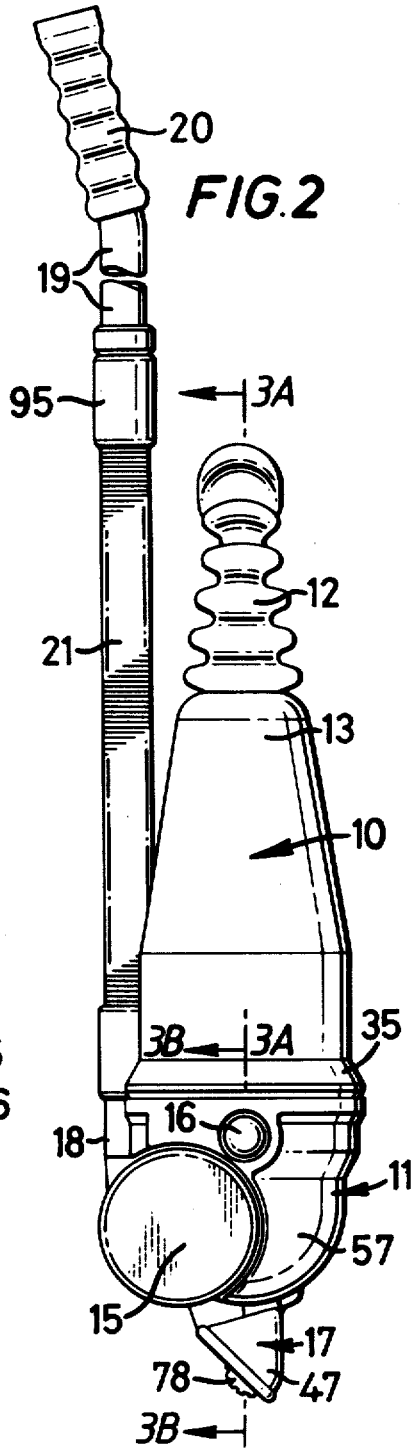
FIG. 2 is a side elevation of the vacuum cleaning appliance of FIG. 1.

Referring now to FIGS. 1 and 2 of the drawings the vacuum cleaning appliance of the invention is shown in its upright mode of operation and it comprises a main casing 10 which is detachably fitted to the top of a casing 11 containing the electric motor and fan unit. The main casing 10 is provided with a rigid U-shaped carrying handle 12 which is connected at its ends to the opposite side portions 13 and 14 of the main casing. The motor casing 11 is fitted at opposite sides with a pair of supporting wheels 15 for the appliance and the casing also includes an on-off push switch 16 for controlling the operation of the electric motor.

A lower cleaner head 17 for engaging a carpet to be cleaned is pivotally mounted on the motor housing 11 so that during use of the appliance the main casing may be pivoted relatively to the cleaner head 17 to allow the passage of the appliance under low furniture such as a bed.

The motor housing 11 is provided with an extension 18 which forms a rigid socket for slidably receiving the lower end of a tubular pipe 19. The pipe 19 at its upper end is fitted with a hand grip 20 and forms a handle for maneuvering the appliance. The pipe 19 slidably fits within a flexible hose 21 which is secured at its lower end around the upper open end of the extension 18 of the casing. The arrangement is such that the pipe 19 when fitted in the socket of the extension 18 enables the handle to be used for maneuvering the appliance as an upright type machine. When the pipe 19 is slidably removed from the socket in the extension 18 the pipe 19 is then used as a cleaner head at the end of the flexible hose 21 thus converting the appliance into a cylinder type machine. The conversion of the appliance from one mode of operation to the other and vice versa will be described hereinafter in greater detail.

Figure 3A:
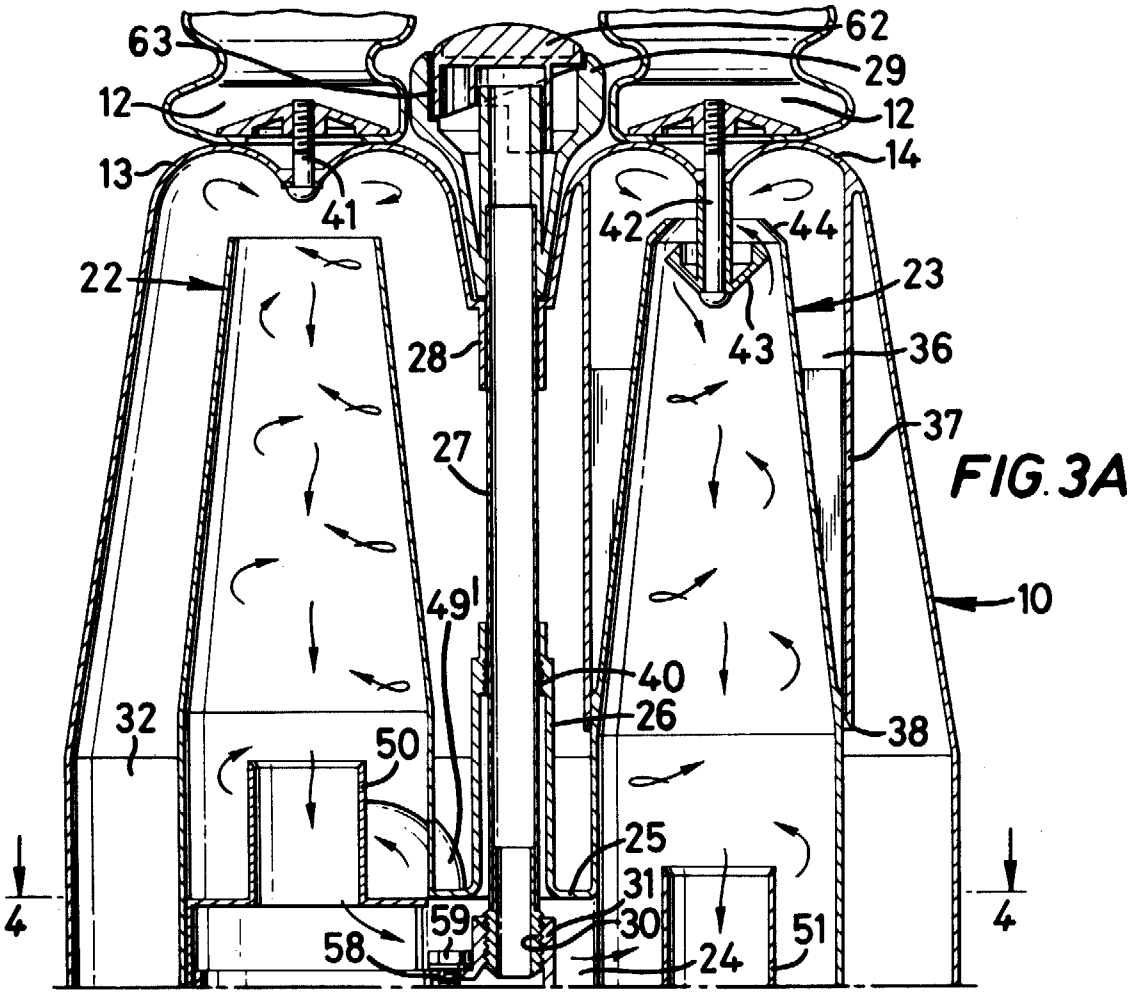
FIG. 3A is a section through the upper part of the vacuum cleaning appliance taken on the line 3A—3A in FIG. 2.
Figure 3B:
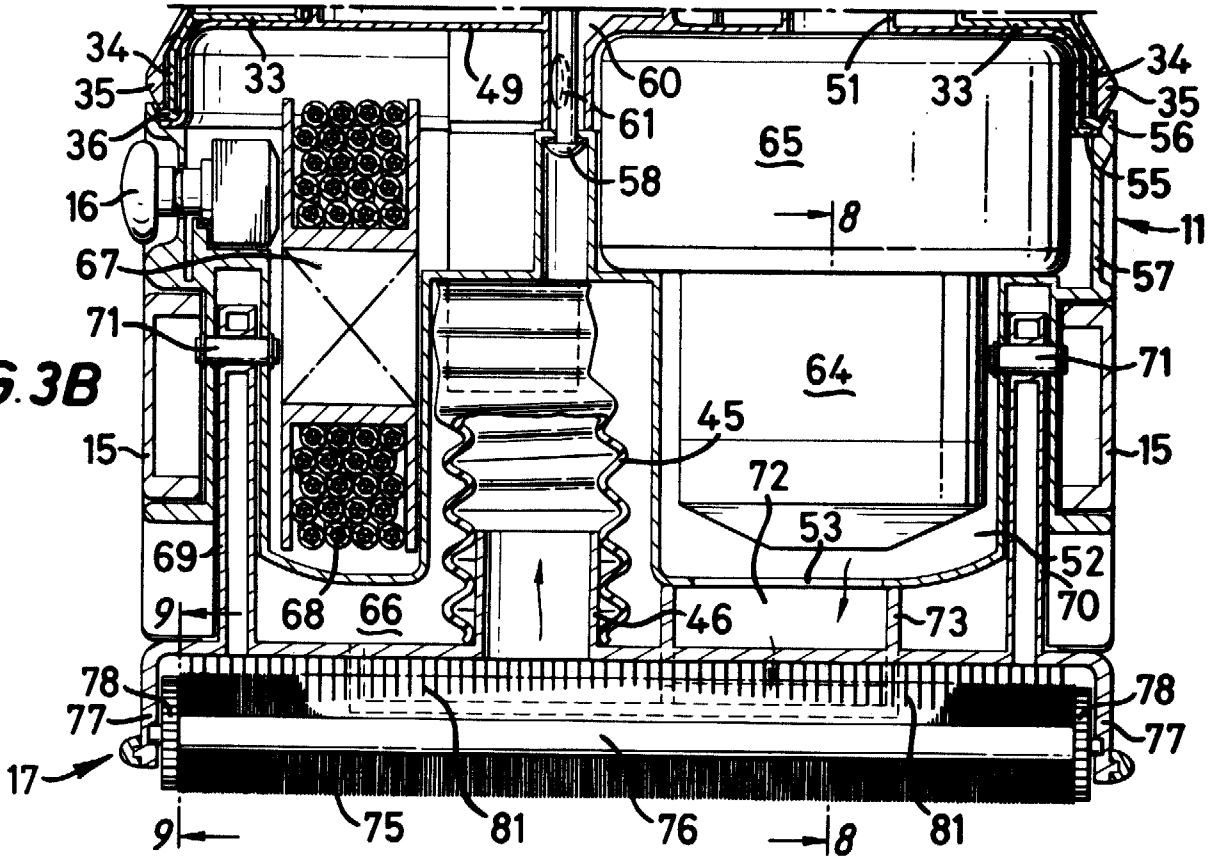
FIG. 3B is a section through the lower part of the vacuum cleaning appliance taken on the line 3B—3B in FIG. 2.

FIGS. 3A and 3B of the drawings when taken in conjunction provide a section through the combined casings 10, 11 and 17 of the appliance.

Referring to FIG. 3A this drawing is a section through the main casing 10 which provides a housing for the main cleaner unit which consists of a pair of cyclones 22 and 23 which are located in series in the air flow through the appliance and which operate to remove by centrifugal action the dust and other dirt entrained in the air as will be hereinafter explained.

Figure 4:
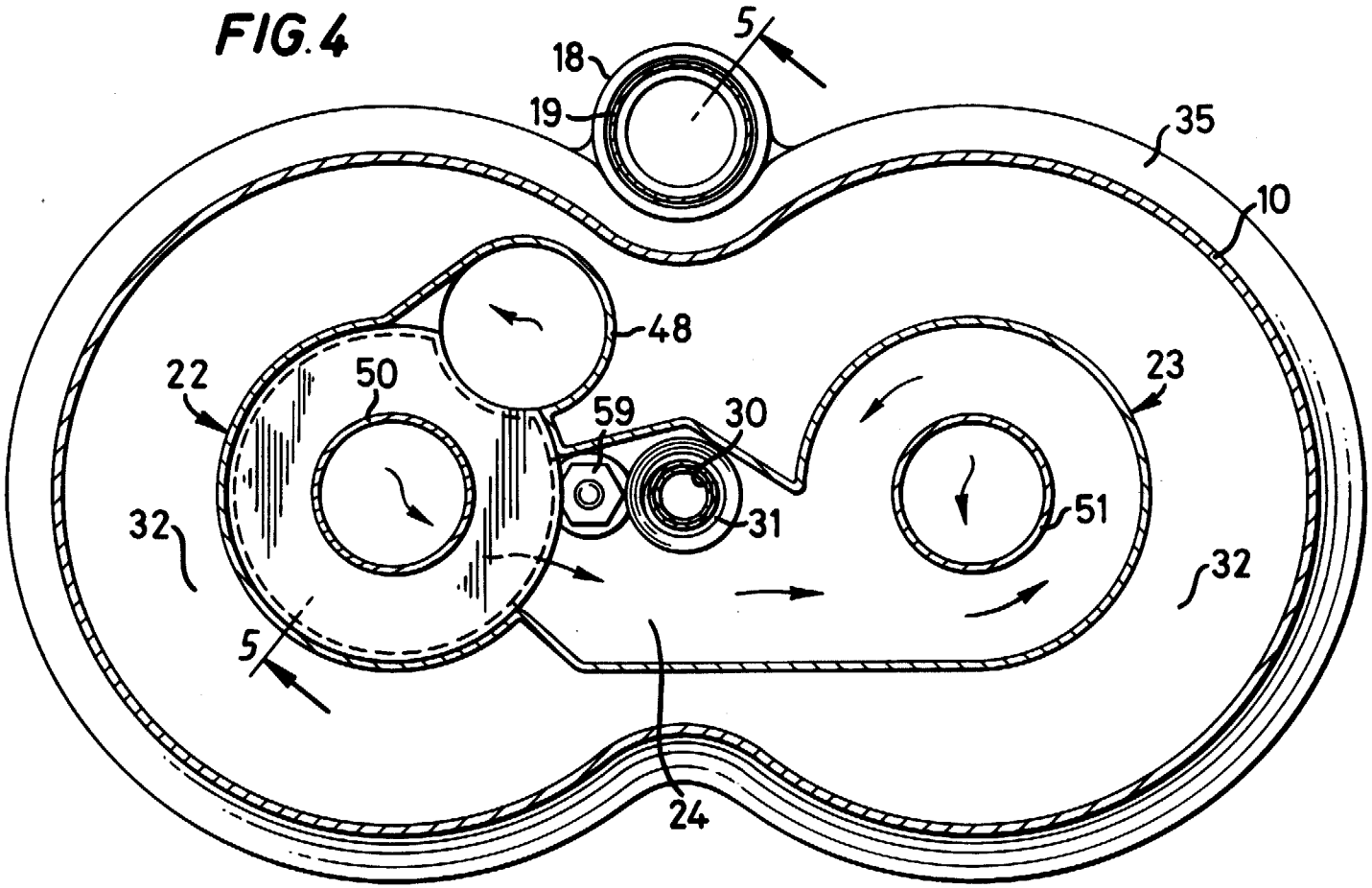
FIG. 4 is a horizontal section through the casing of the vacuum cleaning appliance taken on the line 4—4 in FIG. 3A and showing the direction of air flow through the cyclone units.

The cyclones 22, 23 are located respectively in the communicating portions 13, 14 of the casing 10 and are substantially frusto-conical in shape, being open at the upper smaller ends for the discharge of the entrained dust and other dirt. The cyclones 22, 23 at their lower larger ends are interconnected centrally of the casing so as to provide an intercommunicating passageway 24 (see FIG. 4) for the air flow through the appliance. The passageway 24 is bounded by an upper wall 25 between the cyclones and which has a sleeve 26 extending upwardly therefrom providing a support for a hollow control shaft 27. The hollow control shaft 27 is supported at its upper end by a further sleeve 28 which extends downwardly centrally of the junction of the portions 13, 14 of the casing 10. The shaft extends through the sleeve 28 externally of the casing 10 and is provided with a manually operable control knob 29 by which the shaft is movable both slidably and rotatably within the casing 10. The shaft 27 is slidably movable by the knob 29 into a lower position as shown in FIG. 3A in which its lower threaded end 30 is in threaded engagement with an upstanding threaded sleeve 31 formed on the upper surface of the motor casing 11. When so engaged by the control knob 29 the casing 10 is held firmly in position on the motor casing 11.

The cyclones 22, 23 are spaced from the casing 10 to form therebetween and externally of the cyclones a dirt receiving chamber 32. The duct and other dirt removed from the air flow by the first cyclone 22 is discharged over the upper edge of the cyclone and falls into the chamber 32 on to the lower floor of the chamber which is provided by a flange 33 extending outwardly of the cyclones. The flange 33 has a downwardly extending skirt portion 34 which seats snugly within the outer rim portion 35 of the main casing 10 so as to seal the chamber 32, the skirt portion 34 and the rim 35 also engaging a sealing ring 36 carried by the motor casing 11.

The cyclone 23 is located downstream of the cyclone 22 and provides a fine or secondary cleaning unit. The cyclone 23 is isolated from the cyclone 22 by forming an independent dust receiving chamber 36 by means of a tubular extension 37 which projects downwardly from the upper end of the portion 14 or the casing 10 so that its lower edge 38 slidably and snugly engages the outer surface of the conical cyclone 23 in its operative position as shown in FIG. 3A.

The control knob 29 is rotatable to unscrew the threaded end 30 of the shaft 27 from the threaded sleeve 31 on the motor casing 11. This enables the main casing 10 to be removed from the appliance by means of the U-shaped carrying handle 12. The knob 29 is then operable to move the shaft 27 slidably upwards to engage the threaded end 30 with a threaded portion 40 formed on the sleeve 26. When threadably engaged by rotation of knob 29 a downward force then exerted on the knob 29 and thereby the hollow shaft 27, is operable to separate the cyclones 22, 23 from the casing 10 thus opening the chambers 32 and 36 for the disposal of the extracted dust and dirt.

The casing 10 and the cyclones 22, 23 are reconnected by unscrewing the end of the shaft 27 from the sleeve 40 by rotation of knob 29, and then depressing the knob 29 to engage the screwed end 30 of the shaft 27 with the threaded portion of the upstanding sleeve 31. Rotation of the knob 29 then threadably engages the shaft and this draws the casing 10 into tight engagement with the flange 34 of the cyclones 22, 23 and also positions the assembly firmly on the motor casing 11.

The carrying handle 12 is retained in position on the domed ends of the portions 13, 14 of the casing 10 by connecting bolts 41, 42. The connecting bolt 42 on the portion 14 of the casing is elongated to support also an additional inverted cone member 43 located in the mouth of the cyclone 23. The member 43 is intended to assist in the final extraction of the dust and dirt from the air flow during the centrifugal movement of the air in the cyclone and as shown this may also be assisted by inclining the outer edge 44 of the cyclone. The arrangement shown however is given by way of example only and other designs and arrengements may be used for the cyclone 23 the function of which is primarily the removal of any fine dust or dirt which may have been retained in the air flow after passage through the first cyclone 22.

The air flow enters the casing 10 containing the cyclones through a flexible hose 45 which is attached to a short rigid pipe 46 opening into the casing 47 of the lower cleaner head 17. The hose 45 at its upper end is attached to a short rigid pipe 48 which extends through a horizontal plate 49, which plate is attached to and forms the top plate of the motor casing 11. The pipe 48 connects with a curved entry pipe 49 so as to direct the air flow as shown by the arrows into the base of the cyclone 22 in a tangential manner (see also FIGS. 4 and 5), the air then spiraling up the inner surface of the curved wall of the cyclone to deposit engrained dust and dirt by centrifugal action over the top edge of the cyclone.

Figure 5:
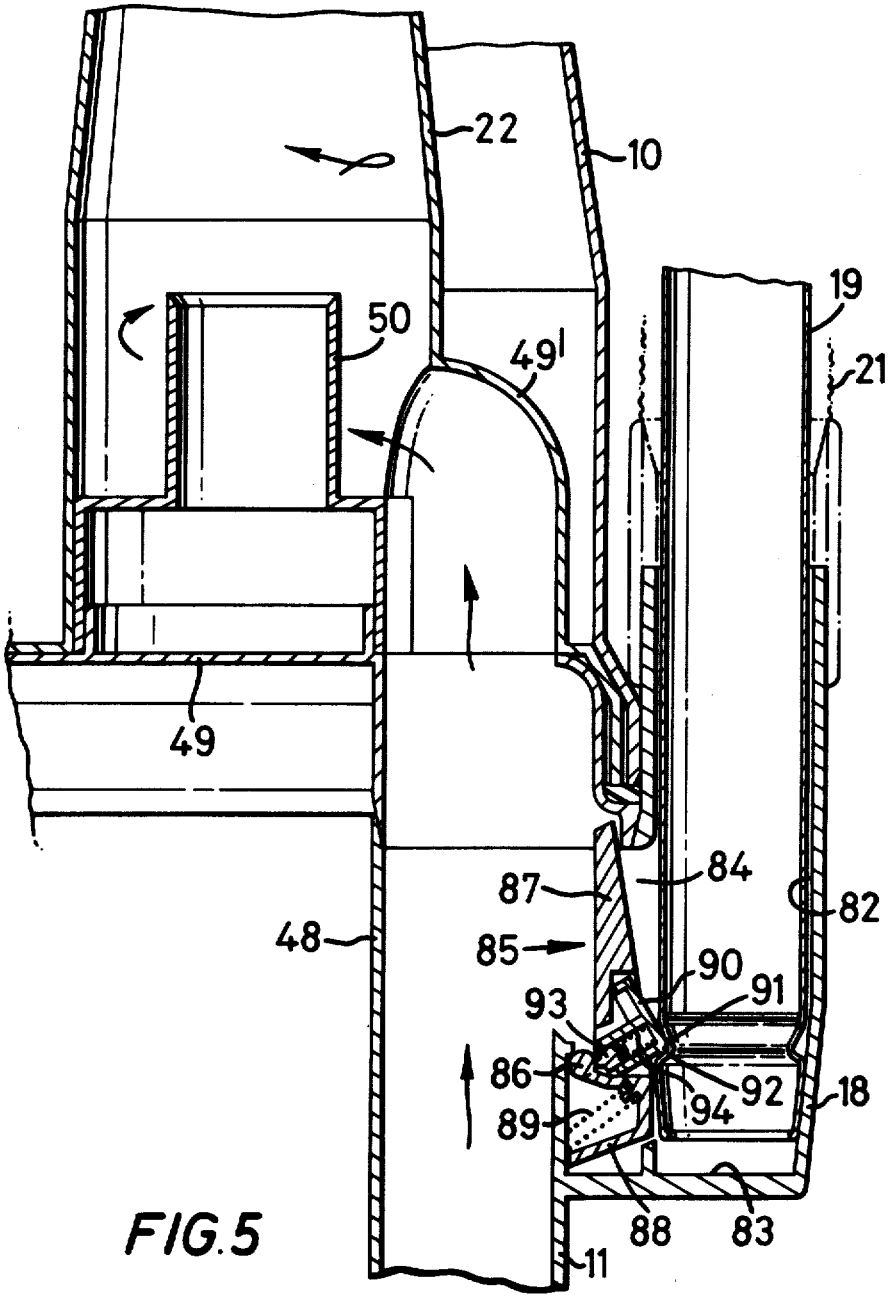
FIG. 5 is a section taken on the line 5—5 in FIG. 4 and showing the valve device controlled by the handle of the appliance for converting it from its upright mode of operation to its cylinder mode of operation and vice versa.

The air flow then passes centrally down the cyclone into a pipe 50 formed in the top plate 49 and then enters the transverse passageway 24 in which sleeve 31 is located (see FIG. 5). The air flow then enters the lower part of the cyclone 23 also in a tangential manner (see FIG. 4) and is again processed in the cyclone so as to remove any further remaining fine dust and dirt.

Figure 8:
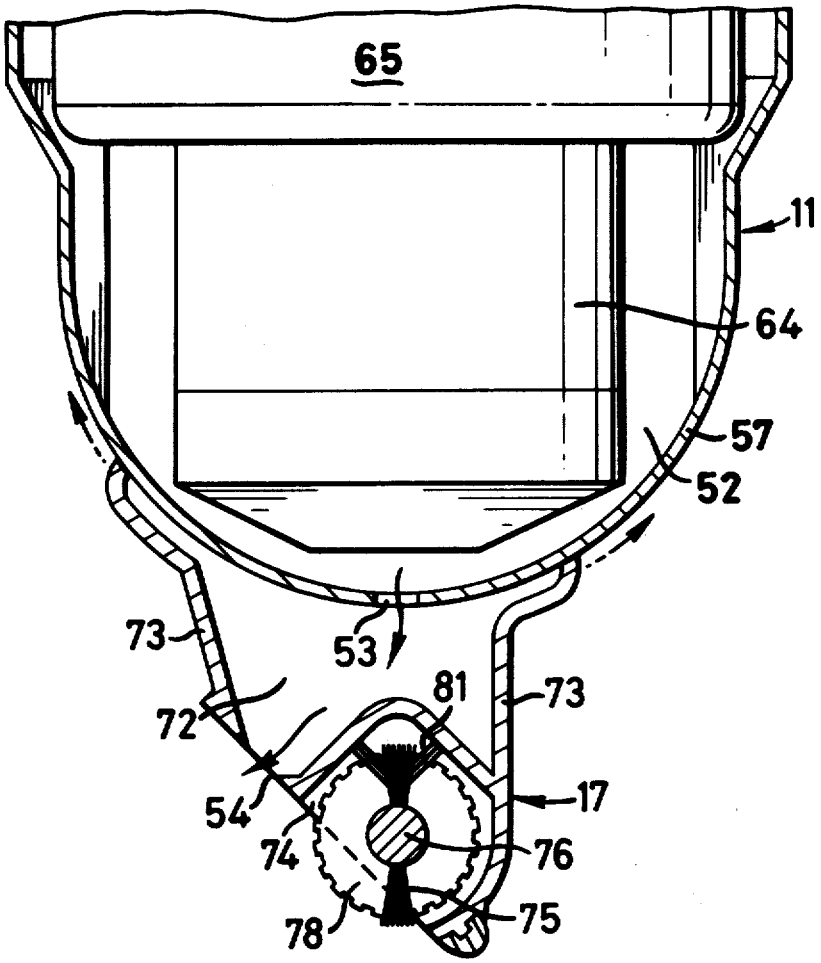
FIG. 8 is a section on the line 8—8 in FIG. 3B showing the carpet engaging section or cleaner head of the appliance.

The air flow then passes centrally down the cyclone 23 to enter a pipe 51 upstanding from the plate 49. The air flow exits from the pipe 51 into the fan and motor chamber 52 of the casing 11, and is then discharged through an aperture 53 into the cleaner head casing 47 from which it discharges into the carpet through an elongated slot 54 (see FIG. 8) formed in the casing.

The plate 49 forming the top plate of the motor casing 11 has an outer peripheral flange 55 which supports the sealing ring 36. The flange 55 furthermore seats in the lip 56 of a housing 57 providing the lower part of the casing 11. The plate 49 is attached to the housing 57 by connecting bolt 58 and nut 59, the bolt extending through a chamber 60 which communicates with the inlet pipe 48 by means of an aperture 61 (see FIG. 3B). The chamber 60 also communicates with sleeve 31 and thereby the interior of the hollow shaft 27. The upper end of the hollow shaft 27 is closed by a plug 62 which is rotatably mounted in the control knob 29. The plug 62 has a skirt portion 63 of varying depth and which is constructed so that as the plug 62 rotates it progressively opens the end of the hollow shaft 27 to atmosphere. In this way the user of the appliance may progressively vent the inlet passageway of the appliance to atmosphere and so vary at will the degree of suction exerted on the carpet being cleaned. This control of the appliance is available whether the appliance is operating in its upright or cylinder mode of operation.

The casing 11 consisting of the top plate 49 and the housing 57 to which it is connected provides firstly the chamber 52 for the motor 64 and the fan 65, and secondly a chamber 66 in which is mounted a spring loaded reel 67 for the electric supply cable 68 of the appliance.

The lower cleaner head casing 47 is elongated in shape and extends across the width of the appliance having a pair of spaced upstanding arms 69 and 70 which are pivotally attached to the casing 11 by means of pivot pins 71 located within slots in the bottom housing 57. The casing 47 is provided with the exit pipe 46 previously mentioned and is also formed with a chamber 72 provided by walls 73 upstanding from the casing 47 and which slidably engage the lower wall of the housing 57 around the aperture 53.

The cleaner head casing 47 furthermore includes a longitudinal open-sided slot 74 in which is located a rotatable brush unit 75. The brush unit comprises opposite sets of bristles and is mounted on a longitudinal shaft 76 pivotally mounted in the end walls 77 of the casing. The shaft 76 also supports the plates 78 which are toothed and one of which comprises a ratchet which is engaged by a pawl 79 during one direction of rotation of the brush unit.

Figure 9:
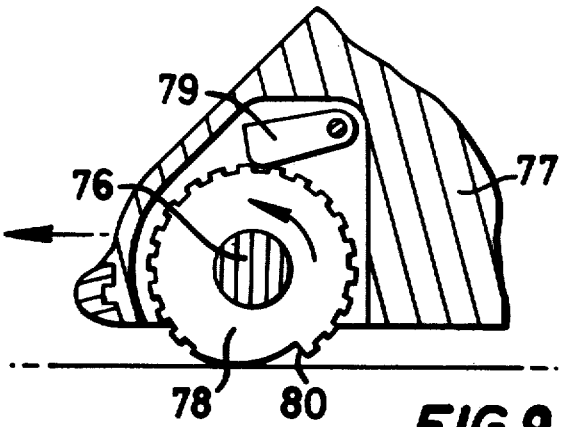
FIG. 9 is a part section on the line 9—9 in FIG. 3B showing the ratchet and pawl arrangement for rotating the carpet engaging brushes.
Figure 10:
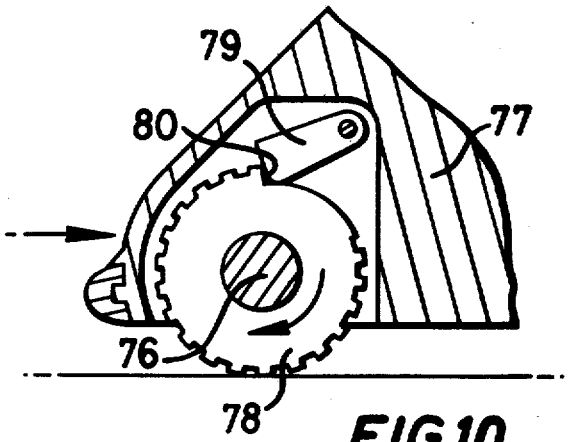
FIG. 10 is a part section similar to FIG. 9 but showing the operation of the ratchet and pawl during a reverse movement of the appliance over a carpet.

During forward movement of the appliance as shown in FIG. 9 the brush unit 75 rotates freely while in contact with the carpet, but during reverse movement as shown in FIG. 10 the pawl 79 engages a ratchet tooth 80 on the corresponding plate 78 so as to prevent reverse movement of the brush unit 75 and which thereby provides a brushing effect of the carpet. During rotation of the brush unit 75 during a forward movement of the appliance, the opposite sets of bristles preferably pass between spaced plates 81 (see particularly FIG. 3B) so as to remove therefrom any accumulated fluff and other dirt which is then sucked into the appliance through the pipe 46.

As previously mentioned the vacuum cleaning appliance of the invention as shown in the drawings is primarily intended for operation as an upright type cleaner, the appliance being manoeuvred by the handle 20 on the end of the tubular pipe 19 which fits the socket in the extension 18 of the motor casing 11.

The invention however provides a further feature in that the appliance may be quickly and simply converted for operation as a cylinder type cleaner and vice versa, merely by the removal and insertion of the tubular pipe 19 in the socket of the casing extension.

Figure 6:
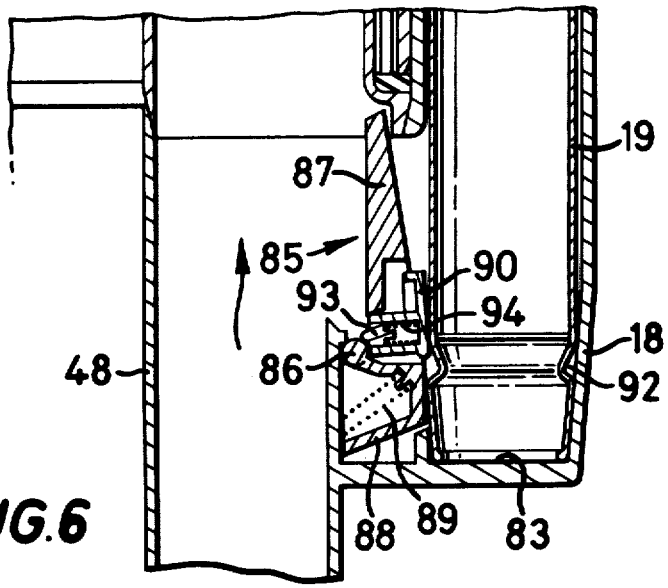
FIG. 6 is a part sectional view similar to FIG. 5 showing the valve device and tubular handle positioned for upright mode of operation of the appliance.
Figure 7:
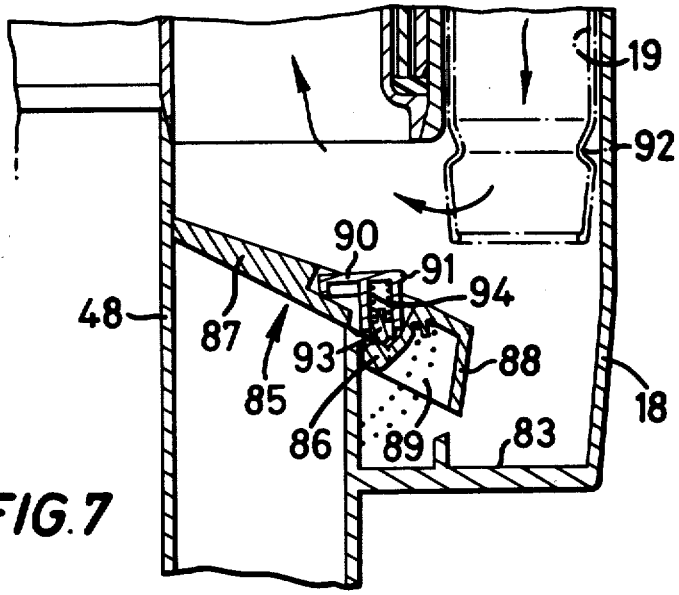
FIG. 7 is a similar part section showing the valve device positioned for cylinder mode of operation of the appliance.

The constructional features which enable this change over are shown more clearly in FIGS. 5 to 7 of the drawings.

FIG. 5 shows the pipe 19 inserted in the extension 18 which provides an open socket 82 for slidably receiving the lower end of the pipe. The socket 82 provides an end seat 83 for the end of the pipe 19, but in its operating mode as an upright cleaner as shown in FIG. 5 the end of the pipe is held spaced from the seat 83 by a valve device shown generally by the reference 85.

The valve device 85 controls an aperture 84 in the side wall of the socket 82 and which communicates the socket with the inlet pipe 48 of the appliance.

The valve device is pivotally mounted at 86 on the casing and it comprises a valve member 87 normally closing the aperture 84. At the other side of the pivot point 86 the valve device has an open sided housing 88 in which is mounted a compression spring 89 normally urging the valve device in an anti-clockwise direction to open the aperture 84. A switch member 90 is also mounted pivotally on the valve device and is moveable relatively thereto. The switch member 90 is formed with a bore which contains a compression spring 94 acting against a slidable plunger 93.

When the appliance is in its upright mode of operation the pipe 19 is located as shown in FIG. 5 with the corner edge 91 of the switch member 90 engaging a groove 92 in the pipe 19. In this position the valve member 87 has closed the aperture 84 and the plunger 93 has engaged a part of the pivot 86 which is on that side of the pivot line adjacent the housing 88. In this position the switch member 90 is locked into position so that anti-clockwise movement of the switch member and valve device is prevented and this retains the pipe 19 firmly in position to act as a handle to manoeuvre the appliance.

In order to convert the appliance to a cylinder type cleaner the pipe 19 is firstly pushed downwardly in the socket 82 into the seat 83 as shown in FIG. 6 of the drawings. As the pipe 19 moves downwardly the switch member pivots clockwise relatively to the valve device and this re-engages the plunger 93 on the opposite side of the line from the pivot 86. The plunger 93 now holds the switch member 90 in the position shown in FIG. 6 which allows for unrestricted removal of the pipe 19 upwardly from the socket 82.

As the pipe 19 moves upwardly the valve device 85 pivots anti-clockwise under the action of its spring 89 to the position shown in FIG. 7. In this position the switch member 90 engages the top edge of the wall of the pipe 48 to allow the plunger to re-engage the opposite side of the line from the pivot point 86 which thus allows anti-clockwise pivotal movement of the switch member 90 relative to the valve device. This sets the switch member for subsequent engagement with the pipe 19 when the pipe is reinserted in the socket 82 for conversion to the upright mode of operation of the appliance.

In this cylinder mode of operation as shown in FIG. 7 the pipe 19 is now connected through the aperture 84 directly with the passageway entering the cyclones. The valve member 87 now closes the inlet connection to the cleaner head and by slidably moving the pipe 19 to the end of the surrounding hose the pipe can be used as a cleaner head which may be fitted with various attachments at the handle 20. The pipe 19 is retained in a sealing tight manner in the outer end of the hose 21 by a cuff 95 which permits sliding of the pipe 19 and the locking therein of the end of the pipe by means of the groove 92.

A particular advantage of the vacuum cleaning appliance of the invention is that no dust bags are required, the dirt being discharged from the appliance by separating the cyclones from the main casing. The use of a cyclone ensures that the dust discharging from the appliance is substantially dust-free and a particular advantage of the use of a cyclone is that during use the dust laden air does not pass through the previously extracted dirt thus avoiding the possible discharge of smells from the removed dirt. Filters are therefore avoided and the use of a cyclone permits the entry into the appliance of articles which would normally cause damage, such as glass and water. The discharge of the dust-free air into the cleaner head helps to dislodge entrained dirt during cleaning and is more efficient than rotating brushes as the air penetrates more deeply into the pile of the carpet and so dislodges dirt and grit which is firmly engrained in the pile. Furthermore, the discharge of the dust-free air as jets into the carpet effectively muffles the fan which greatly reduces the noise during cleaning. Finally, by detaching the lower end of the upright tube from the motor unit housing the appliance may operate as a cylinder cleaner, the open end of the upright tube being then used, with or without attachments, to clean furniture, curtains, or the edges of fitted carpets.

I claim:

1. A vacuum cleaning device convertible alternately, into an upright cleaning appliance and into a cylindrical tank type appliance, said appliance comprising a suction head adapted to be moved over a surface to be cleaned when the appliance is in its upright mode, a first housing having one end pivotally connected to said suction head and having an opposite end, a second housing having a first end fixed to said opposite end of the first housing, a pair of frusto-conically shaped cyclones disposed side by side and enclosed by said second housing, each of said cyclones having a first open end facing said first housing and a larger opposite end, a flexible hose connecting said suction head with one of said frusto-conical cylones for flow of air into the said frusto-conical cyclone, means connecting said side-by-side cyclones for flow of air therebetween, a motor and fan assembly disposed in said first housing for sucking air into said suction head and into said flexible hose, means disposed above each of said first open ends of the frusto-conically shaped cyclones within the said second housing comprising an inverted conically shaped member disposed above the smaller open end of each of the cyclones with its apex facing said smaller open end to interrupt flow of air through the said smaller open end and intercept suspended solids in the air, means comprising third and fourth housings disposed around the cyclones for directing intercepted solids falling from the air towards the first suction head and into a receptacle therefor, means on the first housing for rollably supporting the appliance in its upright mode, and a rotary brush supported across said suction head to contact said surface as the appliance in its upright mode is moved over the surface to be cleaned, means for moving the applicance in its upright mode comprising a pair of wheels rotatably mounted on said first housing;

means fixed to said second housing for lifting and moving the appliance while in its cylindrical tank type mode.

2. The vacuum cleaning device of claim 1 having means for maneuvering said device comprising a threaded socket supported between said cyclones in said second housing, an upstanding pipe threadably secured in said socket and projecting above the said second housing, and a handle on said pipe adapted for grasping by an operator of the device.

3. A vacuum cleaning appliance comprising a cleaner head for engaging a carpet or the like to be cleaned, a main casing connected to the cleaner head by an inlet passageway, and a motor casing enclosing a motor driven fan unit, means detachably connecting said main casing to said motor casing comprising a central rod operable externally of the main casing to engage the motor casing and secure the main casing and the motor casing together and allow separation thereof, said fan unit being operable to draw dust and dirt laden air from the cleaner head through the inlet passageway into the main casing, first and second frusto-conically shaped cyclone units each having a first end and a second larger end disposed in series in an air passageway through said main casing, means for air to enter tangentially into the first cyclone unit through said larger end, said cyclone unit being operable to extract dust and dirt from air flowing throughthrough and deposit it in a chamber separate from the air passageway.

4. A vacuum cleaning appliance as claimed in claim 3, characterised in that said control rod is hollow and communicates with the inlet passageway when attached to the motor casing, and said control rod has a knob operable to vent said passageway to atmosphere through said hollow shaft.

5. A vacuum cleaning appliance as claimed in claim 1 or 2, characterised in that said cleaner head is pivotally attached to said motor casing and that the air from said fan unit is discharged into the atmosphere through said cleaner head.

6. A vacuum cleaning appliance as claimed in claim 1, characterised in that said inlet passageway is connectible to a second cleaner head comprising a rigid hollow pipe slidably mounted in a flexible hose mounted on the motor casing.

7. A vacuum cleaning appliance as claimed in claim 6, characterized in that said rigid pipe is slidable relatively to said flexible hose to engage a valve device alternately opening and closing said inlet passageway, said valve device closing the inlet connection with said first cleaner head in its closed position so as to connect the inlet passageway with said hollow pipe.

8. A vacuum cleaning appliance as claimed in claim 7, characterised in that engagement of said pipe member with said valve device is operable to open said inlet passageway to said first cleaner head and to close said inlet passageway to said hollow pipe, said valve device incorporating a catch member for fixedly engaging said hollow pipe to enable said pipe to act as a handle for the appliance.

* * * * *